US009020389B2

(12) United States Patent
Ito et al.

(10) Patent No.: US 9,020,389 B2
(45) Date of Patent: Apr. 28, 2015

(54) DEVELOPING DEVICE FOR PREVENTING TONER LEAKAGE

(75) Inventors: Yoshinori Ito, Aichi (JP); Hirofumi Kuriki, Aichi (JP); Ryuya Yamazaki, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 11 days.

(21) Appl. No.: 13/599,470

(22) Filed: Aug. 30, 2012

(65) Prior Publication Data

US 2013/0108314 A1 May 2, 2013

(30) Foreign Application Priority Data

Aug. 31, 2011 (JP) ..... 2011-190028

(51) Int. Cl.
*G03G 15/08* (2006.01)

(52) U.S. Cl.
CPC ..... *G03G 15/0898* (2013.01); *G03G 15/0817* (2013.01); *G03G 15/0812* (2013.01)

(58) Field of Classification Search
CPC ..... G03G 15/0812; G03G 15/0817; G03G 15/0898
USPC ..... 399/103, 105, 119, 262, 284
See application file for complete search history.

(56) References Cited

U.S. PATENT DOCUMENTS 5,057,868 A 10/1991 Sekino et al.
6,321,050 B1 11/2001 Sato et al.
6,336,014 B1 * 1/2002 Sato et al. ..... 399/103
6,496,669 B2 * 12/2002 Sato et al. ..... 399/103
6,980,752 B2 12/2005 Kamimura
7,215,902 B2 * 5/2007 Ishii ..... 399/103
7,457,560 B2 * 11/2008 Nakaya et al. ..... 399/103
7,542,705 B2 * 6/2009 Tsunemi et al. ..... 399/284
8,301,056 B2 * 10/2012 Matsushita et al. ..... 399/103
8,478,158 B2 * 7/2013 Matsushita et al. ..... 399/102

(Continued)

FOREIGN PATENT DOCUMENTS

CN 1866134 A 11/2006
CN 101727050 A 6/2010

(Continued)

OTHER PUBLICATIONS

Office Action issued in corresponding Japanese Patent Application No. 2011-190028 mailed Jul. 9, 2013.

(Continued)

*Primary Examiner* — David Gray
*Assistant Examiner* — Carla Therrien
(74) *Attorney, Agent, or Firm* — Banner & Witcoff, Ltd.

(57) ABSTRACT

A developing device is capable of preventing developing agent from leaking from a developing frame of a developer cartridge. The developer cartridge includes a developing agent carrying member including a rubber roller, a first seal including a first fluffing member, and a second seal including a second base member and a second fluffing member fixed thereto. The second base member and the second fluffing member have downstream end portions in a rotational direction of the developing agent carrying member. The downstream end portion of the second base member is positioned upstream of the downstream end portion of the second fluffing member. The downstream end portion of the second fluffing member is nipped between the first fluffing member and the rubber roller.

10 Claims, 10 Drawing Sheets

(56) References Cited

U.S. PATENT DOCUMENTS

| | | | | |
|---|---|---|---|---|
| 8,521,057 | B2 * | 8/2013 | Matsushita et al. | 399/105 |
| 8,792,802 | B2 * | 7/2014 | Ito et al. | 399/103 |
| 2002/0028086 | A1 | 3/2002 | Sato et al. | |
| 2003/0123899 | A1 | 7/2003 | Kamimura | |
| 2006/0257174 | A1 | 11/2006 | Tsunemi et al. | |
| 2010/0092206 | A1 | 4/2010 | Matsushita et al. | |
| 2012/0269538 | A1 | 10/2012 | Matsushita et al. | |
| 2012/0269539 | A1 | 10/2012 | Matsushita et al. | |

FOREIGN PATENT DOCUMENTS

| | | | |
|---|---|---|---|
| EP | 2 175 325 | A2 | 4/2010 |
| JP | 02-210475 | A | 8/1990 |
| JP | H03-144470 | A | 6/1991 |
| JP | 2000221777 | A | 8/2000 |
| JP | 2001027846 | A | 1/2001 |
| JP | 2003-195628 | A | 7/2003 |
| JP | 2010-091987 | A | 4/2010 |

OTHER PUBLICATIONS

First Office Action issued in corresponding Chinese Patent Application No. 201210324535.5 mailed Apr. 2, 2014.

Extended European Search Report issued in corresponding European Application No. 12182294.4, dated Nov. 21, 2014.

Dec. 31, 2014—(CN) Notice of Second Office Action—App 201210324535.5—English Translation.

* cited by examiner

UP
FRONT
LEFT
RIGHT
REAR
DOWN
23
T

DEVELOPING DEVICE FOR PREVENTING TONER LEAKAGE

CROSS REFERENCE TO RELATED APPLICATION

This application claims priority from Japanese Patent Application No. 2011-190028 filed Aug. 31, 2011. The entire content of the priority application is incorporated herein by reference.

TECHNICAL FIELD

The present invention relates to a developing device to be assembled to an image forming device such as a color printer.

BACKGROUND

Conventionally, a developing device detachably attached to an electro-photographic type printer is known. The developing device includes a frame, a developing roller supported to the frame and carrying toner thereon, a thickness regulation blade for regulating a thickness of a toner layer carried on the developing roller, and a seal member preventing toner from leaking from the frame.

The developing device is provided with a developer cartridge having the thickness regulation blade and the seal member. The thickness regulation blade includes a leaf spring member having generally rectangular shape in front view and a pressing portion provided at a free end portion of the leaf spring member and in contact with the developing roller. The seal member is provided with a blade side seal disposed between each widthwise end portion of the leaf spring member and each axial end portion of the developing roller. The seal member is also provided with a side seal at the widthwise end portion of the frame. The side seal is in frictional contact with the outer peripheral surface of the developing roller.

According to this developer cartridge, one end portion of the side seal is positioned to cover the blade side seal, and the blade side seal prevents the toner from leaking through a boundary between the widthwise end portion of the leaf spring and the axial end portion of the developing roller. Further, the side seal prevents the toner from leaking through a boundary between the widthwise end portion of the frame and the outer peripheral surface of the developing roller.

SUMMARY

Downsizing of the developing device has been demanded recently. To this effect, proposed is a developing device in which rotational direction of the developing roller and an extending direction of the leaf spring is coincident with each other at a contacting portion between the developing roller and the pressing portion. However, if the above described sealing structure is applied to the proposed developing device, toner may be leaked through a gap between the side seal and the blade side seal. Therefore, it is an object of the present invention to provide a developing device having a simple construction and capable of preventing toner from leaking from the frame.

In order to attain the above and other objects, the present invention provides a developing device. The developing device includes a frame, a developing agent carrying member, a layer thickness regulator, a pair of first seals, and a second seal. The frame accommodates therein a developing agent. The developing agent carrying member has an outer peripheral surface and defines an axis, and is configured to carry the developing agent on the outer peripheral surface. The developing agent carrying member is rotatable about the axis and provided at the frame. The axis defines an axial direction, and the developing agent carrying member has an axial end portion. The layer thickness regulator is provided at the frame and is configured to regulate a thickness of a layer of the developing agent carried on the outer peripheral surface. The layer thickness regulator includes a first plate member and a second plate member. The first plate member has one end portion provided with a contact portion in contact with the developing agent carrying member and has another end portion supported to the frame. The second plate member is positioned in confrontation with the frame to nip the another end portion of the first plate member between the second plate member and the frame for fixing the first plate member to the frame. A direction from the another end portion to the one end portion is coincident with a direction of rotation of the developing agent carrying member at a contacting portion between the contact portion and the developing agent carrying member. The pair of first seals is each positioned between the axial end portion of the developing agent carrying member and the first plate. The second seal is positioned between the frame and the axial end portion of the outer peripheral surface of the developing agent carrying member. The second seal includes a second base member and a second fluffing member. The second base member is resiliently deformable and positioned to face the frame. The second fluffing member is adhesively bonded to the second base member and in contact with the axial end portion of the outer peripheral surface of the developing agent carrying member. The second seal has a downstream end portion in the rotating direction of the developing agent carrying member. The downstream end portion is nipped between the first seal and the developing agent carrying member. A downstream end portion of the second base member is positioned upstream of a downstream end portion of the second fluffing member in the rotating direction.

According to another aspect of the present invention, the present invention provides a developing device. The developing device includes a frame, a developing agent carrying member, a layer thickness regulator, a pair of first seals, and a second seal. The frame accommodates therein a developing agent. The developing agent carrying member has an outer peripheral surface and defines an axis and is configured to carry the developing agent on the outer peripheral surface. The developing agent carrying member is rotatable about the axis and provided at the frame. The axis defines an axial direction, and the developing agent carrying member has an axial end portion. The layer thickness regulator is provided at the frame and configured to regulate a thickness of a layer of the developing agent carried on the outer peripheral surface. The layer thickness regulator includes a first plate member and a second plate member. The first plate member has one end portion provided with a contact portion in contact with the developing agent carrying member and has another end portion supported to the frame. The second plate member is positioned in confrontation with the frame to nip the another end portion of the first plate member between the second plate member and the frame for fixing the first plate member to the frame. A direction from the another end portion to the one end portion is coincident with a direction of rotation of the developing agent carrying member at a contacting portion between the contact portion and the developing agent carrying member. The pair of first seals is each positioned between the axial end portion of the developing agent carrying member and the layer thickness regulator. The second seal is positioned between the frame and the axial end portion of the outer peripheral surface of the developing agent carrying member.

The second seal includes a second base member and a second fluffing member. The second base member is resiliently deformable and positioned to face the frame. The second fluffing member is adhesively bonded to the second base member and in contact with the axial end portion of the outer peripheral surface of the developing agent carrying member. The second seal has an upstream end portion and a downstream end portion in the rotating direction of the developing agent carrying member. The downstream end portion is nipped between the first seal and the developing agent carrying member. A downstream end portion of the second base member has a thickness smaller than that of an upstream end portion of the second base member in the rotating direction.

BRIEF DESCRIPTION OF THE DRAWINGS

In the drawings;

FIG. 9(*b*) is a side view of a layer thickness regulator of a developer cartridge according to a modified embodiment;

FIG. 10(*b*) is a side view of a second seal according to a first modification in which a second base member has an thin upper portion; and FIG. 10(*c*) is a side view of a second seal according to a second modification in which a second base member has a tapered upper portion.

DETAILED DESCRIPTION

1. Printer

Figure 1:
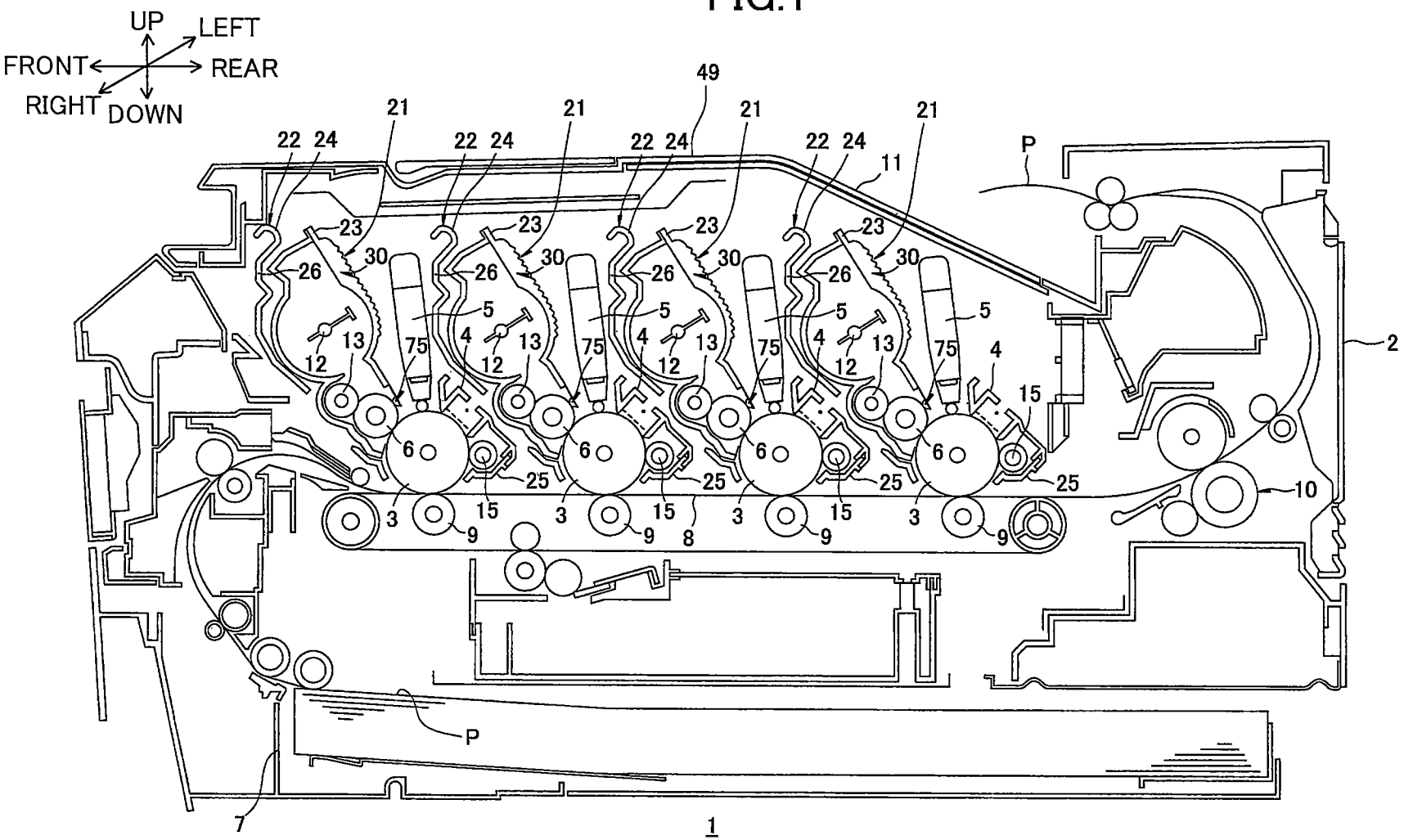
FIG. 1 is a side cross-sectional view of a printer provided with developer cartridges according to one embodiment of the present invention.

A direct tandem type color laser printer 1 assembling developer cartridges 23 is shown in FIG. 1. Throughout the specification, the terms "upward", "downward", "upper", "lower", "above", "below", "beneath", "right", "left", "front", "rear" and the like will be used assuming that the printer 1 is disposed in an orientation in which it is intended to be used. More specifically, the above words are used as if the printer 1 and the developer cartridge 23 are mounted on a horizontal plane, and the words "rightward/leftward direction" is equivalent to "widthwise direction" or "lateral direction". More specifically, "upper", "lower", "frontward" and "rearward" regarding the printer 1 is different from those words regarding the developer cartridge 23, and the developer cartridge 23 is assembled into the printer 1 (into a drum cartridge 22) such that a front side of the developer cartridge 23 is oriented to a front upper side of the printer 1, and rear side of the developer cartridge 23 is oriented to a rear lower side of the printer 1.

The printer 1 includes a main casing 2 in which four photosensitive drums 3 are arrayed in frontward/rearward direction for forming toner images of different colors of black, yellow, magenta and cyan. A scorotron charger 4, an LED unit 5, and a developing roller 6 are provided in confrontation with each photosensitive drum 3.

Each photosensitive drum 3 is exposed to light by the LED unit 5 after each peripheral surface of the photosensitive drum 3 is uniformly charged by the scorotron charger 4. As a result, an electrostatic latent image corresponding to image data can be formed on an electrostatic latent image forming region at each peripheral surface of each photosensitive drum 3. The electrostatic latent image can become a visible toner image by toner carried on an image forming region T of the developing roller 6, the image forming region T being in confrontation with the electrostatic latent image forming region.

A sheet cassette 7 is provided in the main casing 2 for accommodating a stack of sheets P, and a conveyer belt 8 is provided for conveying the sheet P. The sheet P on the sheet cassette 7 can be transferred onto the conveyer belt 8 by conveyer rollers. The conveyer belt 8 extends between each photosensitive drum 3 and each transfer roller 9 in confrontation therewith. Each toner image on each photosensitive drum 3 can be transferred onto a sheet P carried on the conveyer belt 8 by a transfer bias applied to the transfer roller 9, and the toner images are superposed with each other to form a color image on the sheet P.

A fixing unit 10 is provided for thermally fixing the colored toner image. Then the sheet P is discharged onto a discharge tray 11 by way of conveyer rollers. The main casing 2 has an upper wall provided with a top cover 49 which can be opened.

2. Process Cartridge

The printer 1 is provided with four process cartridges 21 for the colors of black, yellow, magenta, and cyan. Each process cartridge 21 is detachably attachable into the main casing 2 and is arrayed in frontward/rearward direction. By opening the top cover 49, each process cartridge 21 can be attached to and detached from the main casing 2. The process cartridge 21 includes a drum cartridge 22 detachable from and attachable to the main casing 2, and a developer cartridge 23 (as a developing device) detachable from and attachable to the drum cartridge 22.

(1) Drum Cartridge

The drum cartridge 22 includes a drum frame 24 having a rear lower portion in FIG. 1 functioning as a drum support portion 25 and a front upper portion in FIG. 1 functioning as a developer cartridge accommodation portion 26. The drum support portion 25 supports the photosensitive drum 3, the scorotron charger 4 and a drum cleaning roller 15.

The photosensitive drum 3 extends in lateral direction and is generally cylindrically shaped, and is rotatably supported to the drum support portion 25 such that a lower portion of the photosensitive drum 3 is exposed to an outside. The scorotron charger 4 is positioned in confrontation with the photosensitive drum 3 with a space therebetween and at diagonally above and rearward of the photosensitive drum 3. The drum cleaning roller 15 is positioned in contact with and rearward of the photosensitive drum 3.

The developer cartridge accommodation portion 26 is positioned diagonally above and frontward of the drum support portion 25. The developer cartridge accommodation portion 26 provides an open space at its rear side opening upward so as to permit the developer cartridge 23 to be detached from and attached to the developer cartridge accommodation portion 26.

(2) Developer Cartridge

Figure 2:
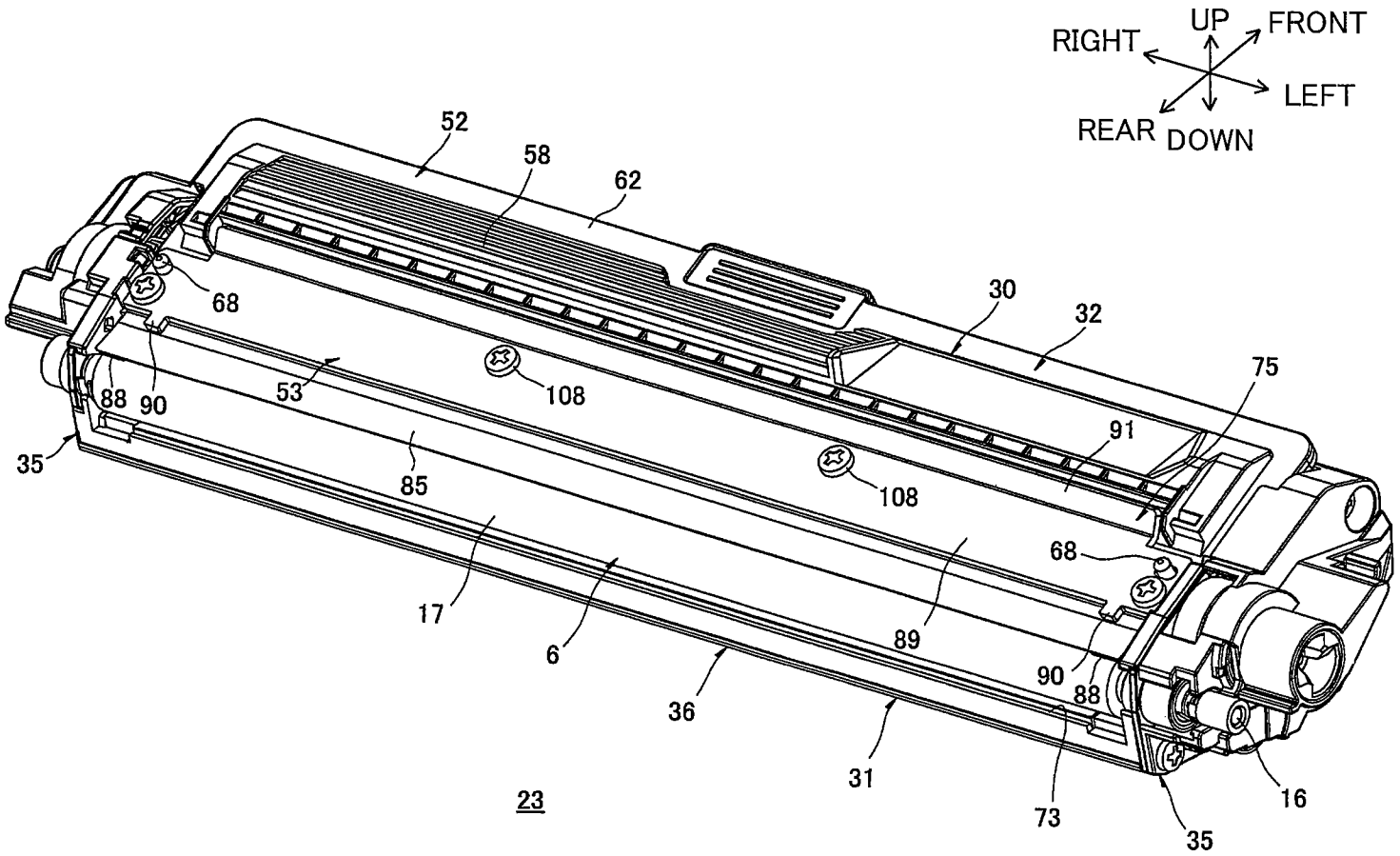
FIG. 2 is a perspective view of the developer cartridge as viewed from an upper left according to the embodiment.

As shown in FIG. 2, the developer cartridge 23 has a frame (developing frame) 30 extending in lateral direction and having a generally box-shape. The frame 30 includes a lower frame 31 and an upper frame 32.

(2-1) Lower Frame

Figure 6:
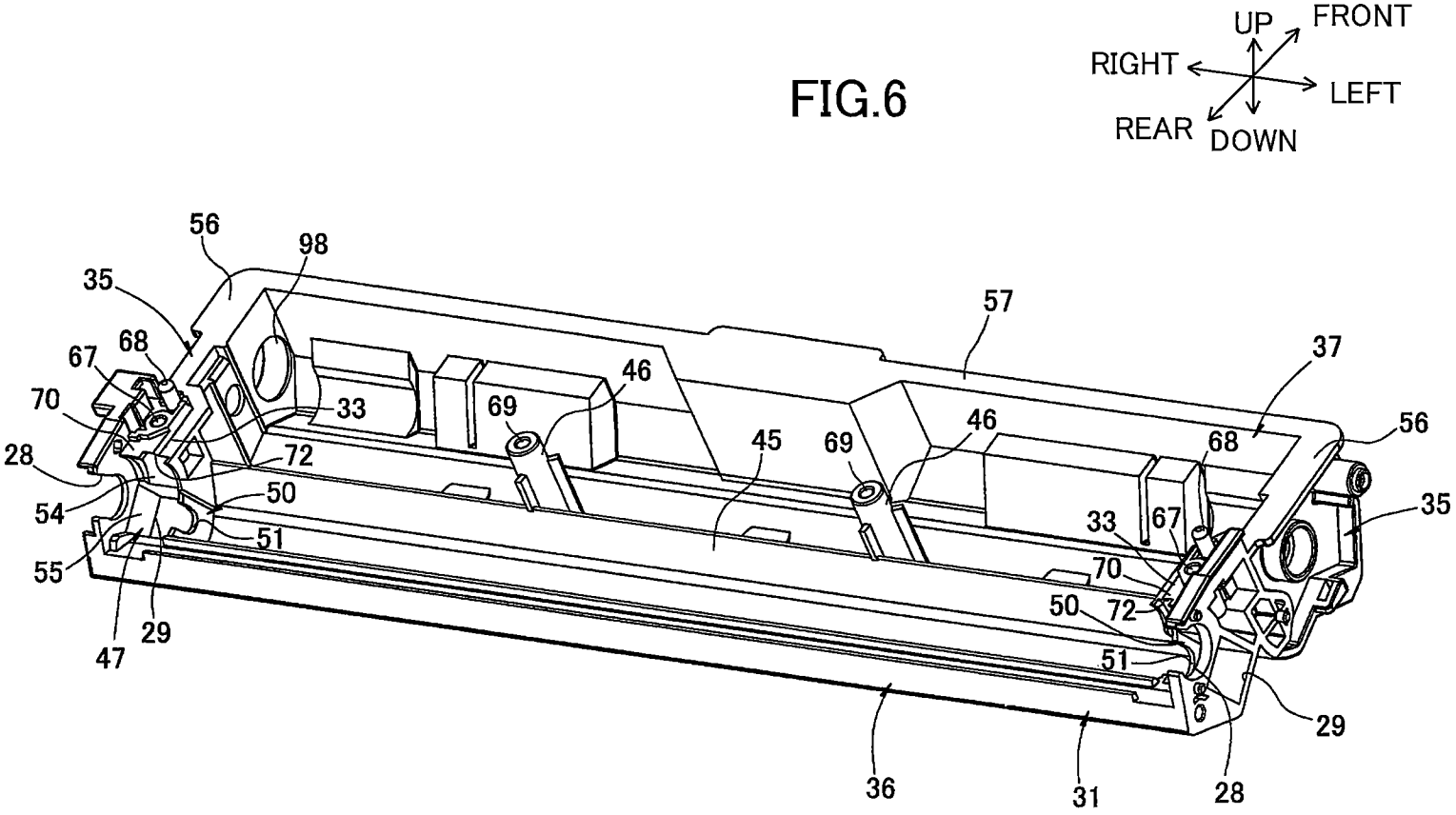
FIG. 6 is a perspective view of a lower frame of the developer cartridge according to the embodiment as viewed from upper left.

As shown in FIG. 6, the lower frame 31 includes a pair of side walls 35 spaced away from each other in the widthwise direction (lateral direction), a bottom wall 36 connecting together each lower end portion of each side wall 35, and a front wall 37 connecting together each front end portion of each side wall 35 and the bottom wall 36. These walls 35, 36, 37 are integrally formed.

Each side wall 35 is generally flat plate shaped and has a front end portion provided with a first abutment portion 56, and has a rear end portion provided with a first fixing portion 33 and formed with a developing roller shaft exposure groove 28 and a supply roller shaft exposure hole 29.

The first abutment portion 56 extends laterally outward from each upper end portion of each side wall 35 and is generally flat plate shaped. Each first fixing portion 33 extends laterally inward from each upper end portion of each side wall 35 and is generally flat plate shaped. Laterally inner ends of the first fixing portions 33 are spaced away from each other in the lateral direction. Further, each first fixing portion 33 has a front portion formed with a first female thread 67 and provided with a positioning protrusion 68, and has a rear portion formed with a seal mounting portion 70.

The first female thread 67 is positioned at an intermediate portion of the first fixing portion 33 in the frontward/rearward direction, and extends throughout a thickness of the first fixing portion 33. The positioning protrusion 68 is positioned frontward of the first female thread 67, and protrudes upward from the first fixing portion 33. Each positioning protrusion 68 has an upper end that is generally arcuate shaped and protrudes upward. A rear end portion of the seal mounting portion 70 has a laterally inner end portion cut away into rectangular shape to provide an exposure region 72.

The developing roller shaft exposure groove 28 is formed at an upper rear end portion of each side wall 35. The developing roller shaft exposure groove 28 is U-shaped recessed diagonally downward and frontward from the upper rear end portion of each side wall 35. The developing roller shaft exposure groove 28 has a groove width greater than a diameter of a developing roller shaft 16 (described later). The developing roller shaft 16 defines an axial direction, which is the "lateral" or "rightward/leftward" direction.

The supply roller shaft exposure hole 29 is generally rectangular shaped in side view. Each side of the supply roller shaft exposure hole 29 has a length greater than a diameter of a supply roller shaft 18. A toner supply port 98 is formed at a front portion of a right side wall 35, and is generally circular shaped in side view.

Figure 4:
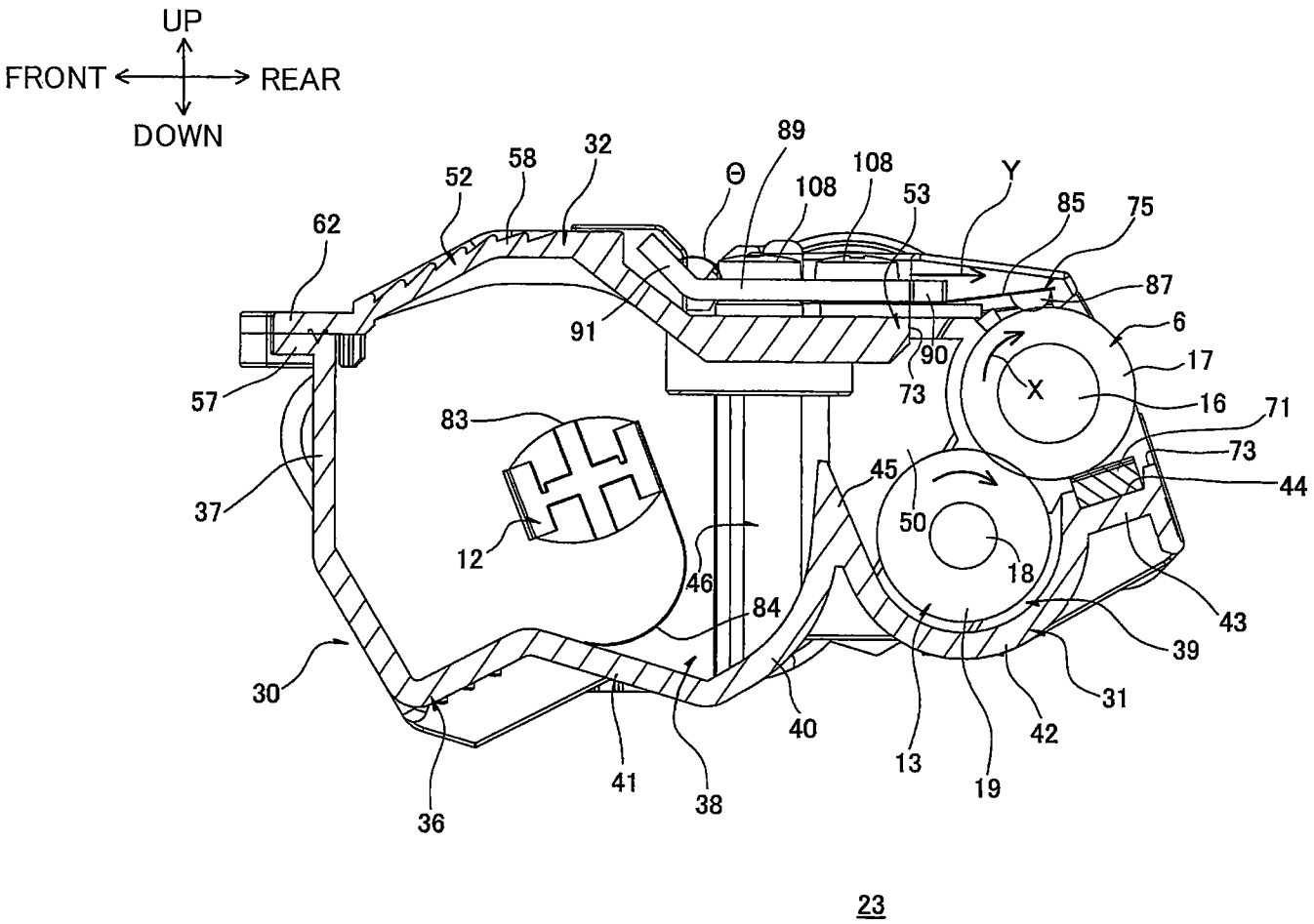
FIG. 4 is a cross-sectional view taken along the line IV-IV in FIG. 3.

As shown in FIG. 4, the bottom wall 36 has a front half portion including a curved wall portion 40 and a bent wall portion 41 continuous therewith, and has a rear half portion including an arcuate wall portion 42 and a lip portion 43 continuous therewith. The curved wall portion 40 is shaped in conformance with a locus of an agitator 12 (described later). The bent wall portion 41 is bent upward. That is, the bent wall portion 41 is oriented diagonally upward and frontward from the front end of the curved wall portion 40 and is then bent to extend diagonally downward and frontward. The arcuate wall portion 42 is shaped in conformance with an outer peripheral surface of or locus of a supply roller 13 (described later).

The lip portion 43 is T-shaped in side view protruding rearward from a rear end portion of the arcuate wall portion 42. The lip portion 43 has an upper surface formed with a lower sponge holding portion 44 which is generally U-shaped in side view opening upward.

The front half portion and the rear half portion of the bottom wall 36 is connected together at a boundary between a rear end of the curved wall portion 40 and a front end of the arcuate wall portion 42. Further, at the boundary portion, a partitioning wall 45 protruding upward is provided. The partitioning wall 45 is continuous with the curved wall portion 40 and the arcuate wall portion 42, and as shown in FIG. 6, the partitioning wall 45 extends in lateral direction and protrudes toward the upper frame 32. A free end of the partitioning wall 45 is in confrontation with and spaced away from a lower surface of a rear upper wall 53 (described later) of the upper frame 32.

Figure 8:
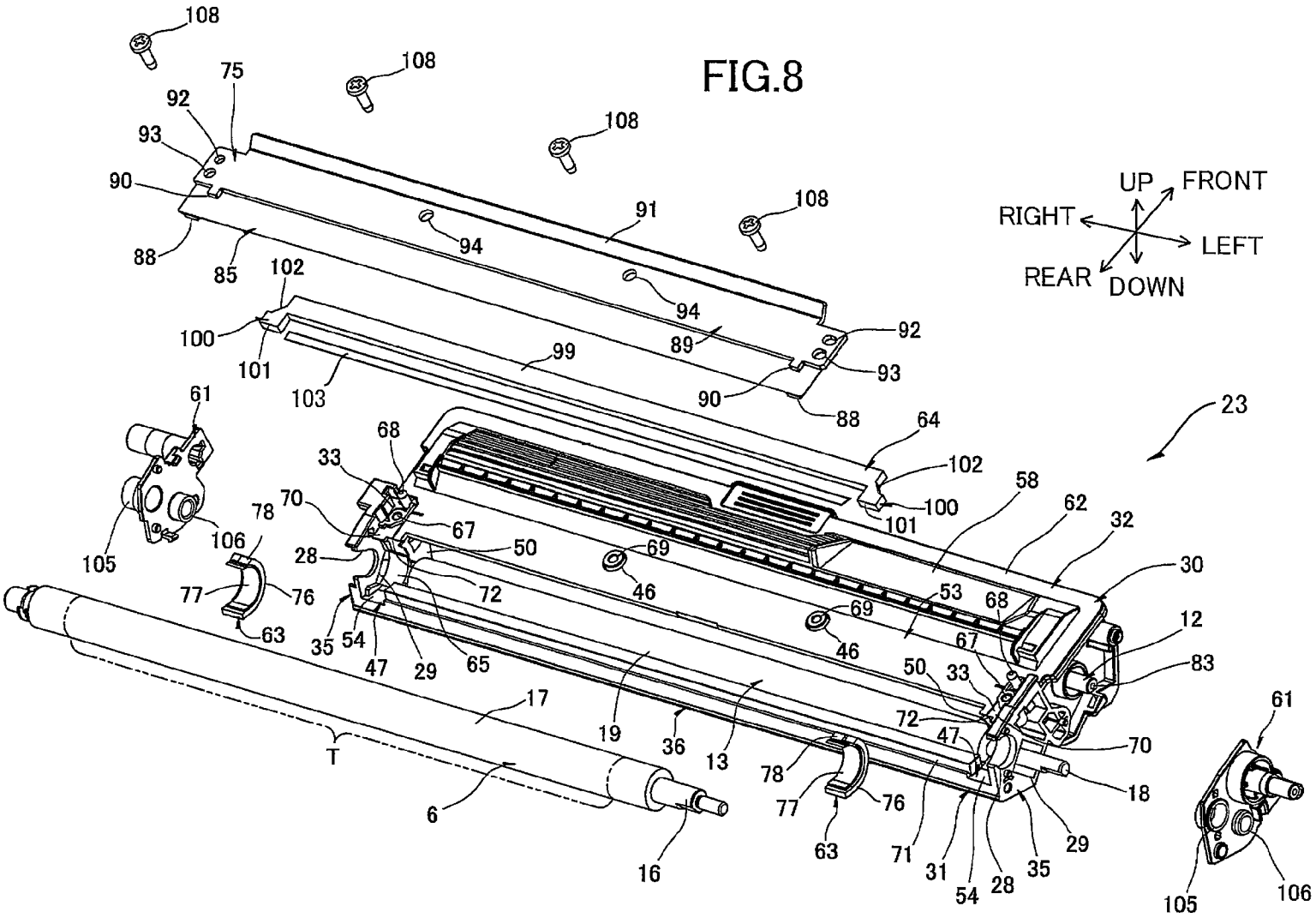
FIG. 8 is an exploded perspective view of the developer cartridge according to the embodiment.

Further, the bottom wall 36 has a plurality of (two) second fixing portions 46 and a plurality of (two) partition walls 50. Each second fixing portion 46 is positioned adjacent to and frontward of the partitioning wall 45, and the second fixing portions 46 are spaced away from each other in the lateral direction. Each second fixing portion 46 upstands from the curved wall portion 40 and is generally cylindrical shaped. Each second fixing portion 46 has an upper free end portion extending through and protruding upward from the rear upper wall 53 (described later) as shown in FIG. 8. The upper free end portion of the second fixing portion 46 is formed with a second female thread 69.

Each partition wall 50 is positioned laterally inward of each side wall 35, and the partition walls 50 are spaced away from each other in the lateral direction. Each partition wall 50 is generally flat plate shaped extending upward from an upper surface of the arcuate wall portion 42 and from a rear surface of the partitioning wall 45. Further, each partition wall 50 has a rear end portion that is arcuate shaped in conformance with a locus of the developing roller 6, and has an upper end portion connected to the laterally inner end portion of the first fixing portion 33. The partition wall 50 has a lower portion formed with a receiving groove 51 for receiving the supply roller shaft 18. The receiving groove 51 is generally U-shaped (in side view) recessed diagonally frontward and downward.

Figure 5:
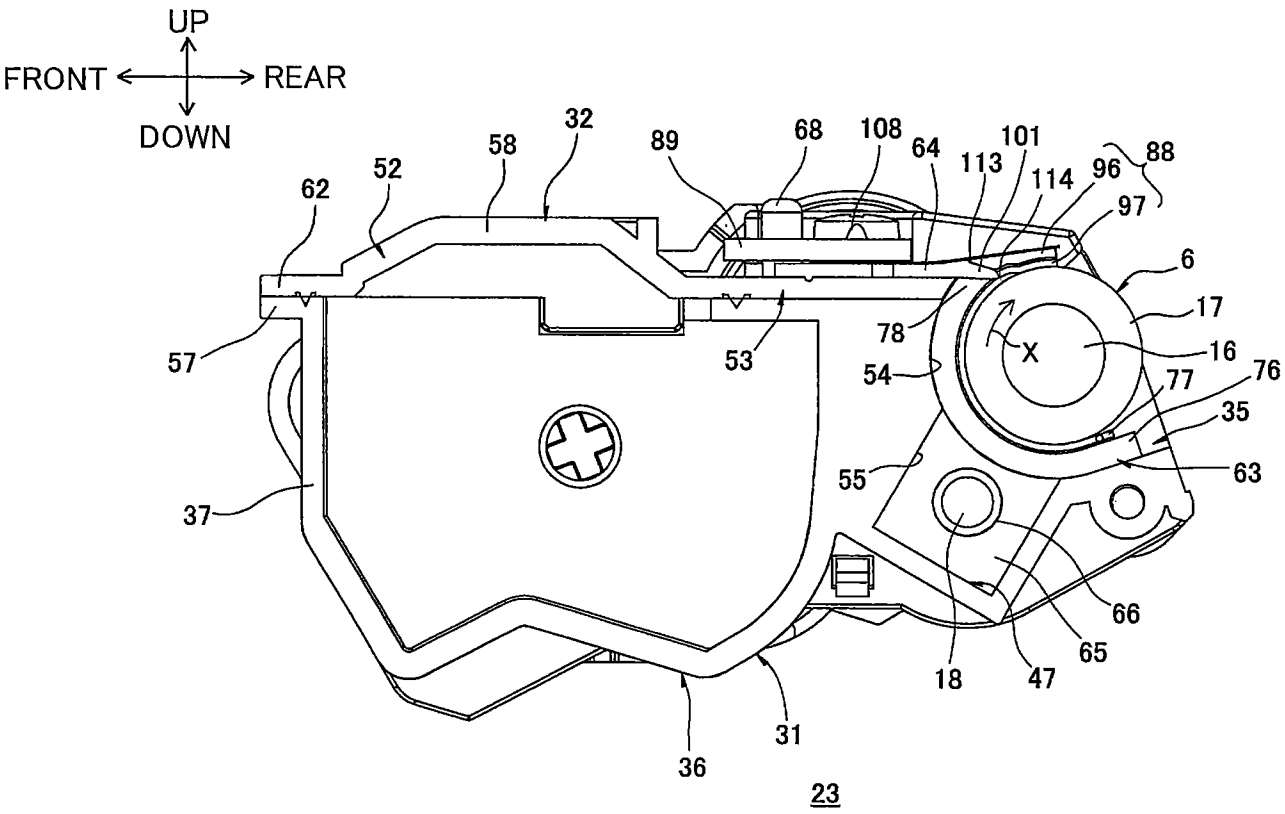
FIG. 5 is a cross-sectional view taken along the line V-V in FIG. 3.

A side seal accommodating portion 47 is defined at the lower frame 31 and between the partition wall 50 and the side wall 35 associated therewith. The side seal accommodating portion 47 has an upper portion in which a second seal accommodating portion 54 is defined and a lower portion in which a fourth seal accommodating portion 55 is defined. As shown in FIG. 5, the second seal accommodating portion 54 is generally U-shaped in side view opening diagonally upward and rearward. The fourth seal accommodating portion 55 is recessed diagonally downward and frontward into rectangular shape in side view from a lower side of the second seal accommodating portion 54. As shown in FIG. 6, the fourth seal accommodating portion 55 is open diagonally upward and rearward and is also open laterally outward through the supply roller shaft exposure hole 29.

As shown in FIG. 4, the front wall 37 has a lower portion integrally extending from a front end portion of the bent wall portion 41 diagonally upward and frontward. The front wall 37 has an upper portion integrally extending from an upper end of the lower portion upward. The upper portion has an upper end portion integrally provided with a second abutment portion 57 protruding frontward and shaped into a generally flat plate.

(2-2) Upper Frame

As shown in FIG. 8, the upper frame 32 includes a front upper wall 52 and the rear upper wall 53. The front upper wall 52 includes a bulged portion 58 bulging upward at an intermediate portion of the front upper wall 52. The front upper wall 52 also includes an abutment portion 62 generally flat plate shaped and positioned at each lateral side and front side of the bulged portion 58 so as to surround the same. The abutment portion 62 is configured to mate with the first abutment portion 56 and the second abutment portion 57 when the upper frame 32 and the lower frame 31 are assembled together. The rear upper wall 53 integrally extends rearward from a rear end portion of the front upper wall 52 and is generally flat plate shaped.

(2-3) Developing Frame

A combination of the lower frame 31 and the upper frame 32 provides the frame 30 of the developer cartridge 23. Within an internal space of the frame 30, a toner chamber 38 and a developing chamber 39 are defined in front of and rearward of the partitioning wall 45, respectively, as shown in FIG. 4.

(2-4) Toner Chamber

Toner as developing agent is accommodated in the toner chamber 38 in which the agitator 12 is positioned at an intermediate portion in frontward/rearward direction and vertical direction. The agitator 12 includes a rotation shaft 83 rotatably supported to the side walls 35, and agitation blades 84 connected to the rotation shaft 83 Each agitation blade 84 is made from flexible film and extends radially outwardly from the rotation shaft 83. Thus, the agitator 12 is rotatable in the frame 30 as shown in FIG. 8 because of the rotatable support of the rotation shaft 83 to the side walls 35.

(2-5) Developing Chamber

The developing chamber 39 has an opening portion 73 open rearward. More specifically, the opening portion 73 is defined by each rear end portion of each side wall 35, a rear end portion of the lip portion 43, and a rear end portion of the rear upper wall 53. Further, the developing roller 6, the supply roller 13, and a layer thickness regulator 75 are provided in an internal space of the developing chamber 39. The developing roller 6 is positioned at a rear end portion of the developing chamber 39 such that an upper rear portion of the developing roller 6 is exposed outside through the opening portion 73.

As shown in FIG. 8, the developing roller 8 includes the developing roller shaft 16 and a rubber roller 17. The rubber roller 17 is disposed over the developing roller shaft 16 such that each axially end portion (lateral end portion) of the developing roller shaft 16 is exposed to an outside. The rubber roller 17 has the image forming region T in confrontation with the electrostatic latent image forming region (not shown) of the photosensitive drum 3 when the developer cartridge 23 is assembled into the drum cartridge 22. The image forming region T is provided at laterally intermediate portion of the rubber roller 17, and has a lateral length nine-tenth of a lateral length of the rubber roller 17.

The developing roller shaft 16 is rotatably supported to each side wall 35 for rotatably supporting the developing roller 6 in the developing frame 30. A drive source such as a motor (not shown) is provided in the main casing 2. A driving force from the motor is transmitted to the developing roller 6 during developing operation. Further, developing bias is applied to the developing roller 6 from a power source (not shown) during developing operation. Upon transmission of the driving force from the motor to the developing roller 6, the developing roller 6 is rotated in a direction X (clockwise direction) as shown in FIG. 4 which is also a rotating direction of the supply roller 13. In other words, at a boundary between the developing roller 6 and the supply roller 13, rotating direction of the developing roller 6 is opposite to that of the supply roller 13.

Further, a lower sponge 71 is positioned immediately below the developing roller 6 such that the lower sponge 71 is in contact with a lower portion of the developing roller 6. The lower sponge 71 is rectangular shaped in side view whose major side extends in the lateral direction as shown in FIG. 8, and is supported on the lower sponge holding portion 44.

The supply roller 13 is positioned in the arcuate wall portion 42 at a position diagonally below and frontward of the developing roller 6. As shown in FIG. 8, the supply roller 13 includes the supply roller shaft 18 and a sponge roller 19. The sponge roller 19 is disposed over the supply roller shaft 18 such that each lateral end portion (axial end portion) of the shaft 18 is exposed to the outside. The sponge roller 19 has a lateral length (axial length) smaller than that of the rubber roller 17.

The supply roller 13 is positioned to provide a contact between the rubber roller 17 and the sponge roller 18. The supply roller 13 is rotatably positioned in the developing frame 30 because each lateral end portion of the supply roller shaft 18 is rotatably supported to each side wall 35.

The driving force from the drive source (motor in the main casing, not shown) is transmitted to the supply roller 13 during developing operation. Further, toner supply bias is applied to the supply roller 13 from the power source (not shown) during developing operation. Upon transmission of the driving force from the motor to the supply roller 13, the supply roller 13 is rotated in the direction (clockwise direction) which is also a rotating direction X of the developing roller 6. In other words, at the boundary between the developing roller 6 and the supply roller 13, rotating direction of the supply roller 13 is opposite to that of the developing roller 6 as shown by an arrow in FIG. 4.

The layer thickness regulator 75 is adapted to regulate a thickness of the toner layer carried on the outer peripheral surface of the rubber roller 17. The layer thickness regulator 75 is positioned in confrontation with the bottom wall 36 such that the rear upper wall 53 is positioned between the layer thickness regulator 75 and the bottom wall 36.

As shown in FIG. 8, the layer thickness regulator 75 includes a blade member 85 and a reinforcing member 89. The blade member 85 is made from a resiliently deformable thin metal plate having a generally plate shape and having a major side extending in the lateral direction and a minor side extending in frontward/rearward direction. The blade member 85 has a front end portion positioned above the rear upper wall 53, and has a rear end portion in confrontation with the outer peripheral surface of the developing roller 6.

A contact portion 87 (FIG. 7) and first seals 88 are provided at the rear end portion of the blade member 85. The contact portion 87 is made from an urethane rubber, and is provided at a lower surface of the blade member 85. The contact portion 87 is elongated in the lateral direction and protrudes downward in generally arcuate shape in side view. As shown in FIG. 4, the contact portion 87 is in contact with the rubber roller 17 of the developing roller 6 from above. More specifically, the blade member 85 is so positioned that a' direction Y from the front end portion to the rear end portion of the blade member 85 is coincident with the rotational direction X of the developing roller 6 at a contacting area between the rubber roller 17 and the contact portion 87.

Figure 7:
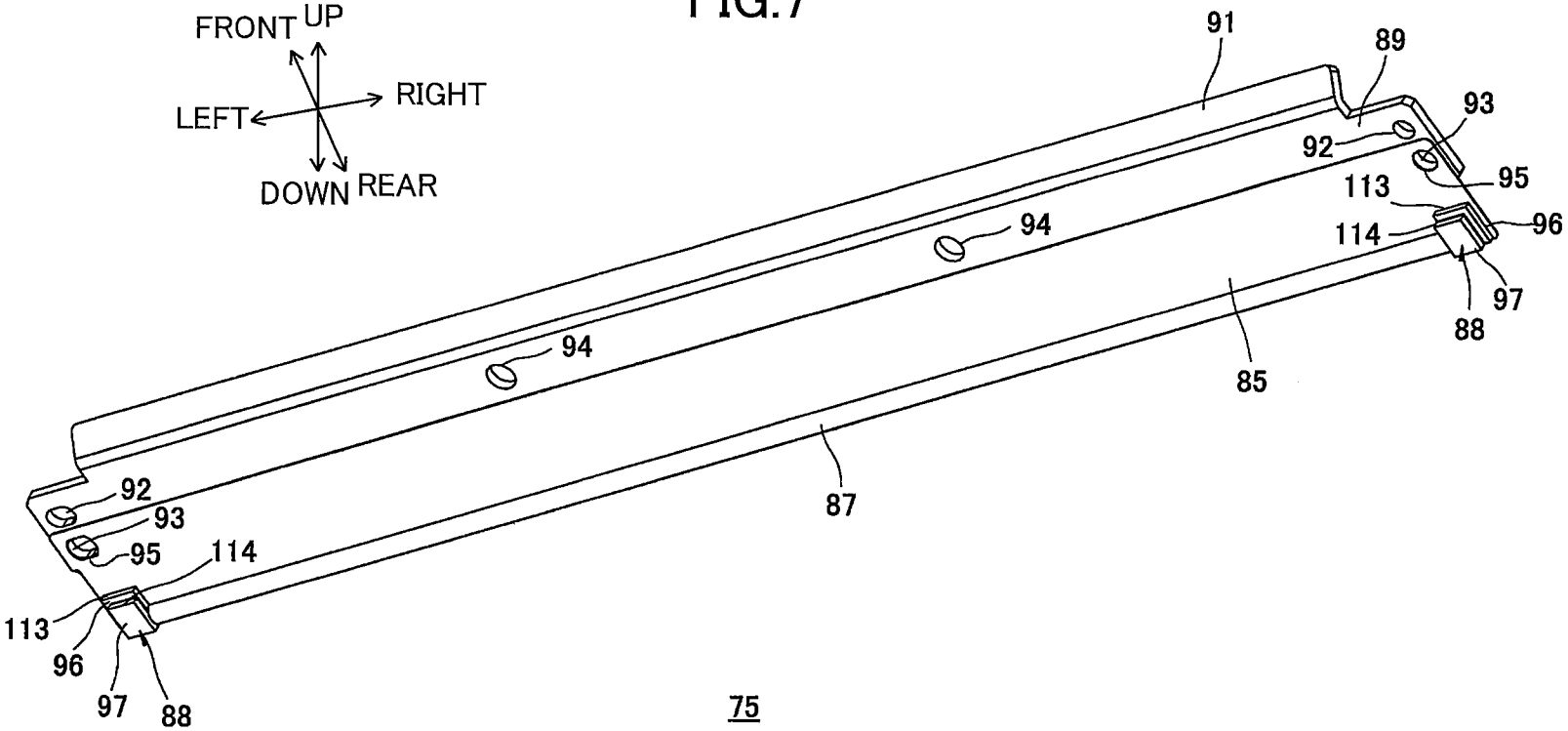
FIG. 7 is a perspective view of a layer thickness regulator of the developer cartridge according to the embodiment as viewed from lower right.

As shown in FIG. 7, each first seal 88 is positioned at each lateral end portion of the lower surface of the blade member 85, such that the contact portion 87 is positioned between the pair of first seals 88. Each first seal 88 includes a first base member 96 and a first fluffing member 97. The first base member 96 is made from a resiliently foaming material such as urethane sponge, and is generally rectangular shaped in bottom view. The first fluffing member 97 is formed of a fabric made from Teflon (trademark) fiber (polytetrafluoroethylene fiber), and is generally rectangular shaped in bottom view. The first fluffing member 97 has a frontward/rearward length and lateral length smaller than those of the first base member 96. The first base member 96 is adhesively bonded to the lower surface of the blade member 85, and the first fluffing member 97 is adhesively bonded to the lower surface of the first base member 96 such that a front end portion and the laterally outer end portion of each first base member 96 is exposed to outside.

Figure 9A:
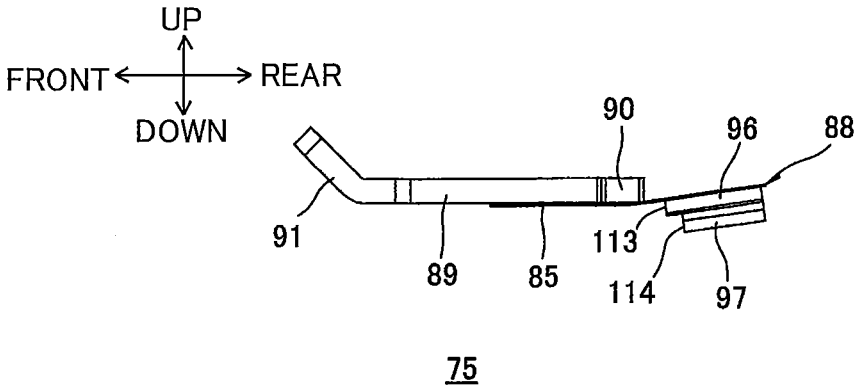
FIG. 9(*a*) is a side view of the layer thickness regulator of the developer cartridge according to the embodiment.
Figure 9B:
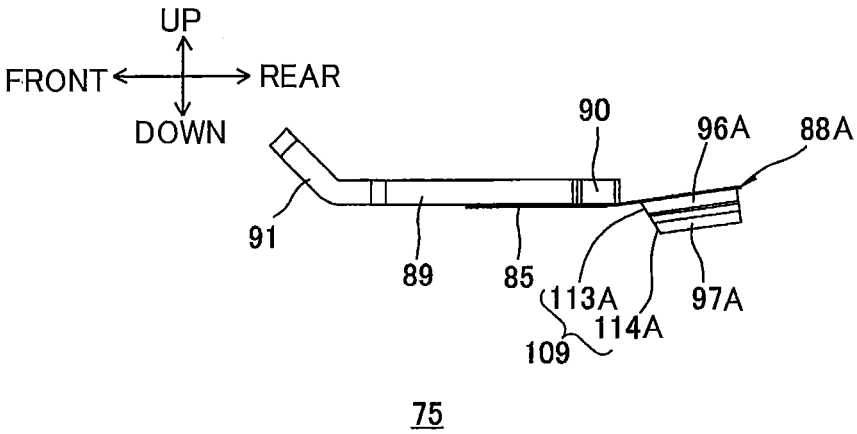

Specifically, as shown in FIG. 9(*a*), the first fluffing member 97 is made smaller than the first base member 96 in the frontward/rearward direction such that a front end portion (a first end portion) 113 of the first base member 96 is positioned frontward of a front end portion (a second end portion) 114 of the first fluffing member 97. That is, a combination of the first end portion 113 and the second end portion 114 form a stepped portion. As shown in FIG. 5, each first fluffing member 97 of each first seal 88 is in contact with each lateral end portion of the rubber roller 17 from above. That is, the first end portion 113 of the first base member 96 is positioned upstream of the second end portion 114 of the first fluffing member 97 in the rotational direction X of the developing roller 6.

As shown in FIG. 8, the reinforcing member 89 is generally flat plate shaped extending in lateral direction, and has a frontward/rearward length smaller than that of the blade member 85. The reinforcing member 89 has a rear end portion provided with a pair of projecting portions 90 projecting rearward therefrom, and has a front end portion integrally provided with an extension portion 91 protruding diagonally upward. The projecting portions 90 are generally rectangular shaped and spaced away from each other in the lateral direction. The extension portion 91 is generally rectangular plate shaped extending in lateral direction. As shown in FIG. 4, inclination of the extension portion 91 is generally coincident with an inclination of the rear portion of the bulged portion 58. That is, the extension portion 91 protrudes in a direction away from the rear upper wall 53. Further, an angle θ defined between the extension portion 91 and the reinforcing member 89 is an obtuse angle such as 135 degrees.

As shown in FIG. 8, each lateral end portion of the reinforcing member 89 is formed with a positioning hole 92 and a first fixing hole 93 arrayed in line therewith in the frontward/rearward direction. The positioning hole 92 is positioned at a position corresponding to the positioning protrusion 68, and the first fixing hole 93 is positioned at a position corresponding to the first female thread 67. Further, the reinforcing member 89 is formed with second fixing holes 94 at positions corresponding to the second female threads 69.

An upper surface at a front end portion of the blade member 85 and a lower surface at a rear end portion of the reinforcing member 89 are adhesively bonded together so that the blade member 85 and the reinforcing member 89 are fixed to each other in which a rear end portion of the blade member 85 is exposed to outside from the reinforcing member 89. Incidentally, the front end portion of the blade member 85 is formed with a through-hole 95 aligned with the first fixing hole 93 as shown in FIG. 7.

The layer thickness regulator 75 is fixed to the lower frame 31 upon being fixed to the first fixing portion 33 and the second fixing portion 46. In the fixing state, the layer thickness regulator 75 is in confrontation with the rear upper wall 53 such that the front end portion of the blade member 85 is nipped between the reinforcing member 89 and the rear upper wall 53.

In the developing chamber 39, two second seals 63, a third seal 64, two fourth seals 65 (FIG. 5), and two bearing members 61 (FIG. 8) are provided. Each second seal 63 is provided corresponding to each second seal accommodating portion 54 and is adapted to prevent toner from leaking through each lateral end portion of the developing chamber 39.

Figure 10A:
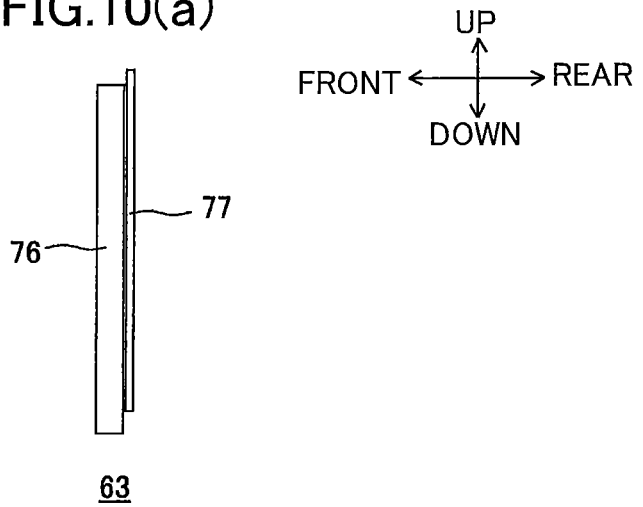
FIG. 10(*a*) is a side view of a second seal of the developer cartridge according to the embodiment.
Figure 10B:
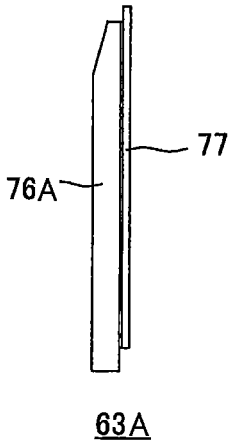
Figure 10C:
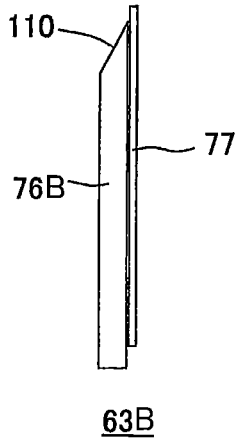

As shown in FIG. 10(*a*), the second seal 63 includes a second base member 76 and a second fluffing member 77. The second base member 76 is formed of resiliently deformable foaming member, and is generally rectangular shape in side view and is elongated in vertical direction. Further, as shown in FIG. 8, an upper end portion of the second base member 76 has a laterally inner end portion provided with a rectangular part 78 protruding upward.

The second fluffing member 77 is formed of a fabric made from cashmere system fiber. As shown in FIG. 10(*a*), the second fluffing member 77 is generally rectangular shaped elongated in vertical direction. The second base member 76 has a vertical length approximately equal to that of the second fluffing member 77, and these are displaced from each other in vertical direction such that an upper end portion of the second fluffing member 77 protrudes upward from the upper end portion of the second base member 76. The second seal 63 is accommodated in the second seal accommodating portion 54 and is deformed into arcuate shape in side view in conformance with a contour of the developing roller 6.

The third seal 64 is formed of resiliently deformable foaming member such as urethane sponge member, and is U-shaped in plan view opening rearward as shown in FIG. 8. The third seal 64 includes an upper part 99 and side parts 100. The upper part 99 extends in lateral direction and is elongated rectangular shaped in plan view. Each side part 100 extends rearward from each lateral end portion of the upper part 99, and is generally flat rectangular shaped. Each side part 100 has a rear end portion provided with a protruding part 101. Further, a notched part 102 in a form of generally rectangular shape in plan view is formed at each corner portion between a front end of the side part 100 and a laterally outer end of the upper part 99. The notched part 102 is configured to expose the first female thread 67 and the positioning protrusion 68 to the outside from above when the third seal 64 is adhesively bonded to the developing frame 30.

In the third seal 64, the upper part 99 is positioned between the upper surface of the rear upper wall 53 and a lower surface of the front portion of the blade member 85, and further, a front portion of each side part 100 is positioned between an upper surface of the first fixing portion 33 (seal mounting portion 70) and a lower surface of each lateral end portion of the blade member 85.

Each fourth seal 65 is adapted to prevent toner from leading from each lateral end portion of the developing chamber 39, and each fourth seal 65 is provided for each lateral end portion of the sponge roller 19. As shown in FIG. 5, each fourth seal 65 is generally rectangular shaped in side view, and has a center portion formed with a penetration hole 66 extending in lateral direction to allow the supply roller shaft 18 to pass therethrough. Further, the fourth seal 65 has an upper surface in a generally arcuate shape in side view recessed diagonally frontward and downward. The fourth seal 65 is accommodated in the fourth seal accommodating portion 55.

Each bearing member 61 is provided for each side wall 35. As shown in FIG. 8, the bearing member 61 is generally rectangular flat plate shaped in side view and is made from an electrically conductive resin. Each bearing member 61 includes a first shaft support portion 105 and a second shaft support portion 106. The first shaft support portion 105 is positioned at a rear upper portion of the bearing member 61 and is generally cylindrical shaped extending through a thickness of the bearing member 61 for rotatably supporting the developing roller shaft 16. The first shaft support portion 105 has an inner diameter approximately equal to or slightly larger than the diameter of the developing roller shaft 16. The second shaft support portion 106 is positioned frontward of and lower than the first shaft support portion 105, and is generally cylindrical shaped extending through the thickness of the bearing member 61 for rotatably supporting the supply roller shaft 18. The second shaft support portion 106 has an inner diameter approximately equal to or slightly larger than the diameter of the supply roller shaft 18. Each bearing member 61 is fitted with the corresponding side wall 36 from laterally outside.

(2-6) Assembly of Developer Cartridge

For assembling the developer cartridge 23, the upper frame 32 is assembled to the lower frame 31 to provide the developing frame 30. For the assembly, the upper frame 32 is overlaid on the lower frame 31 from above such that the abutment portion 62 of the upper frame 32 is aligned with the first abutment portion 56 and the second abutment portion 57 of the lower frame 31. Then, the upper and lower frames 32, 31 are connected to each other by melt-bonding the abutment portion 62 and the first and second abutment portions 56, 57, together. Thus, the developing frame 30 can be provided. In this case, each second fixing portion 46 of the lower frame 31 is protruding from the rear upper wall 53, so that each second female thread 69 is exposed to outside as shown in FIG. 8.

Then, the supply roller 13 is assembled to the lower frame 31. For the assembly, one lateral end portion of the supply roller shaft 18 is positioned at laterally inward of the supply roller shaft exposure hole 29, and is then moved laterally outward so that the supply roller shaft 18 can be inserted into the supply roller shaft exposure hole 29. Then another lateral end portion of the supply roller shaft 18 is inserted into another supply roller shaft exposure hole 29. As a result, the supply roller shaft 18 is received on the receiving groove 51, and accordingly, an outer peripheral surface of the sponge roller 19 is brought into confrontation with an inner peripheral surface of the arcuate wall portion 42 with a minute gap therebetween as shown in FIG. 4. Thus, assembly of the supply roller 13 to the lower frame 31 is completed.

Next, the fourth seal 65 and the second seal 63 are assembled to the lower frame 31. To this effect, each fourth seal 65 is disposed at laterally outer side of each supply roller shaft exposure hole 29 while each penetration hole 66 of the fourth seal 65 is aligned with each lateral end portion of the supply roller shaft 18. Then, each fourth seal 65 is moved laterally inward within the supply roller shaft exposure hole 29 until each fourth seal 65 is brought into contact with a laterally outer surface of the partition wall 50. In this case, each lateral end portion of the supply roller shaft 18 is fully inserted through the penetration hole 66. Thus, the fourth seal 65 is accommodated in the fourth seal accommodating portion 55, and assembly of the fourth seal 65 to the lower frame 31 is completed. In this case, the upper surface of the fourth seal 65 and a front lower surface of the second seal accommodating portion 54 form a continuous surface having generally arcuate shape in side view opening diagonally rearward and upward.

Next, the second seal 63 is assembled to the lower frame 31. To this effect, the second seal 63 is oriented such that the second base member 76 is positioned frontward of the second fluffing member 77, and then the second seal 63 is bent into arcuate shape opening diagonally upward and rearward. Then, the second seal 63 is inserted onto the second seal accommodating portion 54 from diagonally upward and from behind. In this case, as shown in FIG. 5, the second base member 76 and a combination of the second seal accommodating portion 54 and the fourth seal 65 are in contact with each other. Further, the rectangular part 78 of the second base member 76 is positioned at the exposure region 72 of the first fixing portion 33, and the upper end surface of the rectangular part 78 is exposed to the outside from the exposure region 72. Thus, the second seal 63 is assembled to the second seal accommodating portion 54, and assembly of the second seal 63 to the lower frame 31 is completed.

Figure 3:
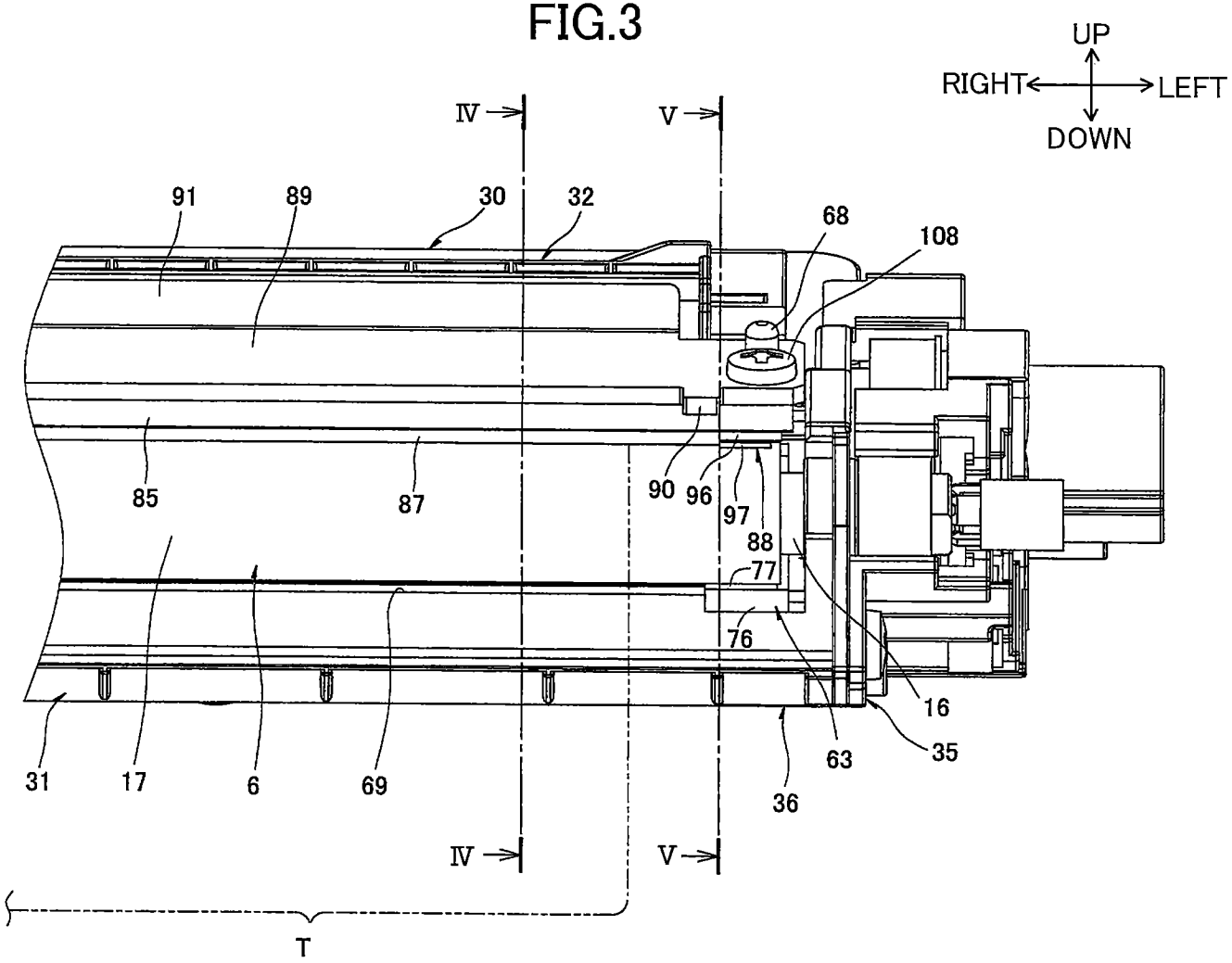
FIG. 3 is an enlarged view showing a left end portion of the developer cartridge as viewed from a rear side thereof.

Next, the developing roller 6 is assembled to the lower frame 31. To this effect, each lateral end portion of the developing roller shaft 16 is inserted into each developing roller shaft exposure groove 28 from above such that the front lower end of the rubber roller 17 is brought into contact with the rear upper end of the sponge roller 19 as shown in FIG. 4. In this case, the second seal 63 is positioned between the lower frame 31 and each laterally outer end portion of the outer peripheral surface of the rubber roller 17 as shown in FIG. 3. More specifically, as shown in FIG. 5, the second base member 76 is in contact with the second seal accommodating portion 54 and the second fluffing member 77 is in contact with the laterally outer end portion of the outer peripheral surface of the rubber roller 17. Further, at the downstream end portion of the second base member 76 with respect to the rotational direction X of the developing roller 6, a rear surface of the second base member 76 is made shorter than a front surface thereof due to the arcuate shaped deformation of the second base member 76. A downstream end portion of the second base member 76 with respect to the rotational direction X of the developing roller 6 is positioned upstream of a downstream end portion of the second fluffing member 77 with respect to the rotational direction X. Thus, assembly of the developing roller 6 to the lower frame 31 is completed.

Next, the two bearing members 61 are assembled to the lower frame 31. More specifically, as shown in FIG. 8, each bearing member 61 is assembled to each side wall 35. To this effect, each bearing member 61 is assembled to each side wall 35 such that each lateral end portion of the supply roller shaft 18 is inserted through the second shaft support portion 106, and each lateral end portion of the developing roller shaft 16 is inserted through the first shaft support portion 105. Thus, assembly of each bearing member 61 to the lower frame 31 is completed whereupon each lateral end portion of the developing roller shaft 16 and each lateral end portion of the supply roller shaft 18 are rotatably supported to each first shaft support portion 105 and each second shaft support portion 106, respectively.

Next, the layer thickness regulator 75 is assembled to the lower frame 31. To this effect, firstly, the layer thickness regulator 75 is positioned on the upper frame 32. More specifically, the third seal 64 is positioned on the upper surface of the rear upper wall 53. In this case, the upper part 99 of the third seal 64 is positioned at the rear end portion of the rear upper wall 53, and each side part 100 of the third seal 64 is protruding rearward and laterally outward from each lateral end portion of the rear upper wall 53 and is positioned on the rear portion of each first fixing portion 33 of the lower frame 31.

The upper part 99 and a portion of the side part 100 except the protruding part 101 are fixedly bonded to the rear upper wall 53 and the upper surface of the seal mounting portion 70 with an adhesive tape 103. Accordingly, the protruding part 101 protrudes rearward from the rear end portion of the seal mounting portion 70, and is in contact with the downstream end portion of the second seal 63 in the rotational direction X of the developing roller 6. Further, a portion of the protruding part 101 corresponding to the exposure region 72 is in contact with the rectangular part 78 of the second seal 63 (FIG. 5).

Next, the layer thickness regulator 75 is overlaid on the rear upper wall 53 from above while gripping the extension portion 91 of the reinforcing member 89. More specifically, in the mounting state, each positioning protrusion 68 of the first fixing portion 33 extends through each positioning hole 92 of the reinforcing member 89, and each first female thread 67 is aligned with the first fixing hole 93. In this state, each first fixing portion 33 is positioned laterally outward of each protruding portion 90 of the reinforcing member 89. Further, each first seal 88 is nipped between the blade member 85 and each lateral end portion of the rubber roller 17, as shown in FIG. 3.

Further, as shown in FIG. 5, the first end portion 113 of the first base member 96 of the first seal 88 is positioned upon the protruding part 101 of the third seal 64, and is nipped between the blade member 85 and the protruding part 101. Further, the downstream end portion of the second fluffing member 77 in the rotational direction X is nipped between the front end portion of the first fluffing member 97 of the first seal 88 and the rubber roller 17. Further, each protruding part 101 is positioned between each first seal 88 and each lateral end portion of the rubber roller 17. More specifically, the protruding part 101 is nipped between the first end portion 113 of the first fluffing member 97 and the rectangular part 78 of the second base member 76. Thus, positioning of the layer thickness regulator 75 onto the upper frame 32 is completed. In this case, each second female thread 69 of each second fixing portion 46 is exposed to the outside through the corresponding second fixing hole 94.

Next, the layer thickness regulator 75 is fixed to the lower frame 31. To this effect, two male threads 108 are threadingly engaged with first female threads 67 through the first fixing holes 93, and two male threads 108 are threadingly engaged with the second female threads 69 through the second fixing hole 94. Thus, the reinforcing member 89 is fixed to the first and second fixing portions 33, 46, and thus, the blade member 85 is fixed to the lower frame 31. Accordingly, assembly of the layer thickness regulator 75 to the lower frame 31 is completed.

Next, toner is filled into the toner chamber 38 through the toner supply port 98, and then, the toner supply port 98 is plugged by a cap (not shown) to hermetically accommodate the toner in the toner chamber 38. Thus, assembly of the developer cartridge 23 is completed. In this case, as shown in FIG. 3, each first seal 88 is positioned laterally inward of each lateral end portion of the reinforcing member 89. Incidentally, in the following description a positional relationship among the first seal 88, the projecting portion 90, and the developing roller 6, will be described with reference to the left end portion in FIG. 3. However, the right end portion has a construction the same as that of the left end portion.

The position of left end portion (laterally outer end portion) of the projecting portion 90 is aligned with the position of right end portion (laterally inner end portion) of the first seal 88 and with the position of the left end portion of the contact portion 87 in the lateral direction. That is, each projecting portion 90 is positioned laterally inward of the first seal 88. Further, each projecting portion 90 is positioned outside of the image forming region T of the rubber roller 17 in the lateral direction.

3. Operation and Effect (1) According to the developer cartridge 23, as shown in FIG. 5, in the second seal 63, the downstream end portion of the second base member 76 is positioned upstream of the downstream end portion of the second fluffing member 77 in the rotational direction X of the developing roller 6. In other words, the downstream end portion of the second fluffing member 77 is protruding downstream of the downstream end portion of the second base member 76 in the rotational direction X. Therefore, the downstream end portion of the second fluffing member 77 in the rotational direction X can conform with the first seal 88.

Accordingly, stable intimate contact between the second seal 63 and the first seal 88 can be provided even if the downstream end portion of the second seal 63 in the rotational direction X, i.e., the downstream end portion of the second fluffing member 76 in the rotational direction X is positioned so as to be nipped between the first seal 88 (first fluffing member 97) and the rubber roller 17. Consequently, any formation of a space or gap at the boundary between the first seal 88 and the second seal 63 can be prevented, and toner leakage through the space or gap can be prevented. As a result, toner leakage from the developing frame 30 can be prevented while permitting the developer cartridge 23 to be compact.

(2) The developer cartridge 23 has the third seal 64. More specifically, the third seal 64 has the upper part 99 positioned between the front end portion of the blade member 85 and the rear upper wall 53, and has the side part 100 whose front end portion is positioned between the front end portion of the blade member 85 and the first fixing portion 33 (seal mounting portion 70). Therefore, toner leakage through a boundary between the front end portion of the blade member 85 and the rear upper wall 53 can be prevented.

Further, the first seal 88 has the first base member 96 and the first fluffing member 97, and the first base member 96 has the first end portion 113 positioned upstream of the second end portion 114 of the first fluffing member 97 in the rotational direction X of the developing roller 6. Further, the first end portion 113 is positioned so as to be nipped between the blade member 85 and the protruding part 101 of the side part 100. Therefore, the protruding part 101 can conform with the first end portion 113. Accordingly, the first end portion 113 can be stably in contact with the protruding part 101 even if the first end part 113 is positioned to be nipped between the blade member 85 and the protruding part 101. Consequently, any formation of space or gap at a boundary between the first seal 88 and the third seal 64 can be prevented, and toner leakage through the space or gap can be avoided.

(3) Further, the third seal 64 has the upper part 99 and the side parts 100, and each side part 100 has the protruding part 101. The upper part 99 and the side parts 100 except the protruding parts 101 are adhesively bonded to the rear upper wall 53 and the first fixing portion 33. Further, the protruding part 101 is positioned between the first end portion 113 and the rubber roller 17. More specifically, the protruding part 101 is nipped between the first end portion 113 and the rectangular part 78. The protruding part 101 is not adhesively fixed to the upper frame 32. Therefore, the protruding part 101 is more resiliently deformable than the upper part 99 and the side part 100 those being adhesively fixed to the upper frame 32. Accordingly, the protruding part 101 can be in intimate contact with the first end portion 113 and the rectangular part 78. Consequently, toner leakage through the boundary between the front end portion of the blade member 85 and the rear upper wall 53 can be prevented, and toner leakage through the boundary between the first seal 88 and the second seal 63 can be prevented.

(4) Further, the first fixing portion 33 is provided at the lower frame 31, and the notched portion 102 is formed in the side part 100. Therefore, accurate relative position between the contact portion 87 and the developing roller 6 provided at the lower frame 31 can be obtained, because the reinforcing member 89 is fixed to the lower frame 31. Further, the reinforcing member 89 can be easily fixed to the first fixing portion 33 because the first female thread 67 and the positioning protrusion 68 are exposed to the outside through the notched portion 102.

4. Modifications

According to the above-described embodiment, the first end portion 113 and the second end portion 114 of the first seal 88 define the stepped portion as shown in FIG. 9(*a*). On the other hand, according to a first modification shown in FIG. 9(*b*), a first base member 96A and a first fluffing member 97A has a first end portion 113A and a second end portion 114A, respectively, and the first and second end portions 113A and 114A is slanted to provide a continuous slant surface 109 extending diagonally downward and rearward. This structure provides operation and effect the same as those of the foregoing embodiment.

FIG. 10(*b*) shows a first modification to the second seal 63. According to the modification, a second seal 63A has a second base member 76A whose upper front end portion is slanted diagonally upward and rearward. An uppermost end portion of the second base member 76A has a certain thickness. This portion corresponds to the downstream end portion of the second base member 76A in the rotational direction X of the developing roller 6. That is, the downstream end portion of the second base member 76A has a thickness (in a radial direction of the developing roller 6) smaller than that of the upstream end portion of the second base member 76A.

FIG. 10(*c*) shows a second modification to the second seal 63. According to the second modification, a second seal 63B has a second base member 76A whose upper front end portion is slanted diagonally upward and rearward to form a slant surface 110. The slant surface extends to the uppermost end of the second base member 76A to provide an angled tip end.

According to the modifications shown in FIGS. 10(*b*) and 10(*c*), the downstream end portion of the second base member 76A, 76B in the rotational direction X has the thickness smaller than that of the upstream end portion thereof. Therefore, the thin wall portion can further conform with the first seal 88. Accordingly, formation of a space or gap at the boundary between the second seal 63 and the first seal 88 can further be prevented, and toner leakage through the boundary can further be prevented. Incidentally, any conceivable combination of the embodiment and modifications is available among FIG. 9(*a*) through 10(*c*).

While the invention has been described in detail with reference to the embodiments thereof, it would be apparent to those skilled in the art that various changes and modifications may be made therein without departing from the scope of the invention.

What is claimed is:

1. A developing device comprising:

a frame for accommodating therein a developing agent;

a developing agent carrying member having an outer peripheral surface and defining an axis, and configured to carry the developing agent on the outer peripheral surface, the developing agent carrying member being rotatable in a rotating direction about the axis and provided at the frame, the axis defining an axial direction, and the developing agent carrying member having an axial end portion;

a layer thickness regulator provided at the frame and configured to regulate a thickness of a layer of the developing agent carried on the outer peripheral surface, the layer thickness regulator comprising:

a first plate member having one end portion provided with a contact portion in contact with the developing agent carrying member and having another end portion supported to the frame; and a second plate member positioned in confrontation with the frame to nip the other end portion of the first plate member between the second plate member and the frame for fixing the first plate member to the frame, a direction from the other end portion to the one end portion being coincident with the rotating direction at a contacting portion between the contact portion and the developing agent carrying member;

a pair of first seals each positioned between the axial end portion of the developing agent carrying member and the first plate member;

a second seal positioned between the frame and the axial end portion of the outer peripheral surface of the developing agent carrying member, the second seal comprising:

a second base member resiliently deformable and positioned to face the frame; and a second fluffing member adhesively bonded to the second base member and in contact with the axial end portion of the outer peripheral surface of the developing agent carrying member, the second seal having a downstream end portion in the rotating direction of the developing agent carrying member, and the downstream end portion being nipped between the first seals and the developing agent carrying member; and a third seal positioned between the frame and the other end portion of the first plate member, wherein each of the first seals comprises:

a first base member resiliently deformable and provided at the layer thickness regulator, the first base member having a first end portion at an upstream end portion thereof in the rotating direction of the developing agent carrying member; and a first fluffing member adhesively bonded to the first base member and in contact with the axial end portion of the developing agent carrying member, the first fluffing member having a second end portion at an upstream end portion thereof in the rotating direction of the developing agent carrying member, wherein the first end portion is positioned upstream of the second end portion in the rotating direction, and the first end portion is positioned to be nipped between the layer thickness regulator and the third seal, and wherein a downstream end surface of the second base member is positioned upstream of a downstream end surface of the second fluffing member in the rotating direction.

2. The developing device as claimed in claim 1, wherein the third seal comprises:

a first part positioned between the first seal and the second seal; and a second part positioned to be nipped between the first plate member and the frame, the second part being exclusively adhesively fixed to the frame by an adhesive tape.

3. The developing device as claimed in claim 2, wherein the frame has a pair of fixing portions to which the second plate member is fixed, the pair of fixing portions being spaced away from each other in the axial direction; and wherein the third seal has a notched portion at which the pair of fixing portions is exposed to an outside.

4. A developing device comprising:

a frame for accommodating therein a developing agent;

a developing agent carrying member having an outer peripheral surface and defining an axis, and configured to carry the developing agent on the outer peripheral surface, the developing agent carrying member being rotatable in a rotating direction about the axis and provided at the frame, the axis defining an axial direction, and the developing agent carrying member having an axial end portion;

a layer thickness regulator provided at the frame and configured to regulate a thickness of a layer of the developing agent carried on the outer peripheral surface, the layer thickness regulator comprising:

a first plate member having one end portion provided with a contact portion in contact with the developing agent carrying member and having another end portion supported to the frame; and a second plate member positioned in confrontation with the frame to nip the other end portion of the first plate member between the second plate member and the frame for fixing the first plate member to the frame, a direction from the other end portion to the one end portion being coincident with the rotating direction of the developing agent carrying member at a contacting portion between the contact portion and the developing agent carrying member;

a pair of first seals each positioned between the axial end portion of the developing agent carrying member and the layer thickness regulator, a second seal positioned between the frame and the axial end portion of the outer peripheral surface of the developing agent carrying member, the second seal comprising:

a second base member resiliently deformable and positioned to face the frame; and a second fluffing member adhesively bonded to the second base member and in contact with the axial end portion of the outer peripheral surface of the developing agent carrying member, the second seal having an upstream end portion and a downstream end portion in the rotating direction of the developing agent carrying member, and the downstream end portion being nipped between the first seals and the developing agent carrying member; and a third seal positioned between the frame and the other end portion of the first plate member, wherein each of the first seals comprises:

a first base member resiliently deformable and provided at the layer thickness regulator, the first base member having a first end portion at an upstream end portion thereof in the rotating direction of the developing agent carrying member; and a first fluffing member adhesively bonded to the first base member and in contact with the axial end portion of the developing agent carrying member, the first fluffing member having a second end portion at an upstream end portion thereof in the rotating direction of the developing agent carrying member, wherein the first end portion is positioned upstream of the second end portion in the rotating direction, and the first end portion is positioned to be nipped between the layer thickness regulator and the third seal, and wherein the second base member has a slanted surface such that a downstream end portion of the second base member has a thickness smaller than that of an upstream end portion of the second base member in the rotating direction.

5. The developing device as claimed in claim 4, wherein the third seal comprises:

a first part positioned between the first seal and the second seal; and a second part positioned to be nipped between the first plate member and the frame, the second part being exclusively adhesively fixed to the frame by an adhesive tape.

6. The developing device as claimed in claim 5, wherein the frame has a pair of fixing portions to which the second plate member is fixed, the pair of fixing portions being spaced away from each other in the axial direction; and wherein the third seal has a notched portion at which the pair of fixing portions is exposed to an outside.

7. A developing device comprising:

a frame for accommodating therein a developing agent;

a developing agent carrying member configured to rotate in a rotating direction about an axis defining an axial direction, the developing agent carrying member having an outer peripheral surface and a first axial end portion in the axial direction;

a layer thickness regulator having a one end portion in contact with the outer peripheral surface and another end portion opposed to the one end portion, the one end portion having a contact portion in contact with the outer peripheral surface, a direction from the other end portion to the one end portion being coincident with the rotating direction at the contact portion, the layer thickness regulator having a second axial end portion in the axial direction;

a first seal positioned between the second axial end portion and the developing agent carrying member; and a second seal positioned between the first axial end portion and the frame, the second seal comprising:

a second base member in contact with the frame and having a first downstream end surface in the rotating direction; and a second contact member fixed to the second base member and in contact with the outer peripheral surface, the second contact member having a second downstream end surface in the rotating direction, wherein the first downstream end surface and the second downstream end surface are positioned between the first seal and the first axial end portion, and wherein the first downstream end surface is positioned upstream of the second downstream end surface in the rotating direction.

8. The developing device according to claim 7, wherein the first downstream end surface is a slanted surface.

9. The developing device according to claim 7, further comprising:

a third seal positioned between the frame and the other end portion of the layer thickness regulator, wherein the first seal comprises:

a first base member in contact with the layer thickness regulator and having a first end portion at an upstream end portion thereof in the rotating direction; and a first contact member fixed to the first base member and in contact with the outer peripheral surface of the developing agent carrying member, the first contact member having a second end portion at an upstream end portion thereof in the rotating direction, and wherein the first end portion is positioned upstream of the second end portion in the rotating direction.

10. The developing device according to claim 9, wherein the third seal comprises a nipped portion positioned between the layer thickness regulator and the frame, the nipped portion being adhesively bonded to the frame.

* * * * *